US011613933B2

(12) United States Patent
Hebert et al.

(10) Patent No.: US 11,613,933 B2
(45) Date of Patent: Mar. 28, 2023

(54) CONCENTRIC COILED TUBING DOWNLINE FOR HYDRATE REMEDIATION

(71) Applicant: Halliburton Energy Services, Inc., Houston, TX (US)

(72) Inventors: Galen Roy Hebert, Breaux Bridge, LA (US); Eric Bivens, Littleton, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/788,791

(22) Filed: Feb. 12, 2020

(65) Prior Publication Data

US 2021/0246733 A1 Aug. 12, 2021

(51) Int. Cl.

| | |
|---|---|
| ***E21B 17/00*** | (2006.01) |
| ***E21B 17/20*** | (2006.01) |
| *E21B 41/00* | (2006.01) |

(52) U.S. Cl.
CPC ..... *E21B 17/006* (2013.01); *E21B 17/20* (2013.01); *E21B 41/0099* (2020.05)

(58) Field of Classification Search
CPC ..... E21B 17/006; E21B 17/20; E21B 41/0099
See application file for complete search history.

(56) References Cited

U.S. PATENT DOCUMENTS

| | | | | |
|---|---|---|---|---|
| 6,279,660 | B1 * | 8/2001 | Hay | E21B 43/36 166/336 |
| 6,497,290 | B1 | 12/2002 | Misselbrook et al. | |
| 6,712,150 | B1 | 3/2004 | Misselbrook et al. | |
| 9,797,223 | B1 * | 10/2017 | Gordon | E21B 37/10 |
| 10,273,785 | B2 | 4/2019 | Older et al. | |
| 2004/0104030 | A1 * | 6/2004 | Livingstone | E21B 21/10 166/77.2 |
| 2005/0205261 | A1 | 9/2005 | Andersen et al. | |

(Continued)

FOREIGN PATENT DOCUMENTS

WO 2011/127411 A2 10/2011

OTHER PUBLICATIONS

International Search Report and Written Opinion issued in related PCT Application No. PCT/US2020/018218 dated Oct. 30, 2020, 12 pages.

*Primary Examiner* — Abby J Flynn
*Assistant Examiner* — Yanick A Akaragwe
(74) *Attorney, Agent, or Firm* — Kilpatrick Townsend & Stockton LLP

(57) ABSTRACT

A hydrate remediation system and method utilizing a concentric coiled tubing downline is provided. The concentric coiled tubing downline includes an outer coiled tubing and an inner coiled tubing, the inner coiled tubing disposed within the outer coiled tubing and extending at least partially through the outer coiled tubing. The concentric coiled tubing downline may be deployed from a single surface reel housed on a surface vessel. A bottom hole assembly (BHA) including a subsea connector is disposed at a distal end of the concentric coiled tubing. The subsea connector of the BHA is configured to be connected to the subsea interface that will be depressurized via the concentric coiled tubing downline. The concentric coiled tubing downline may provide two flow paths. Pressurized gas flows down one flow path, and effluent from the hydrate remediation flows up to the surface via the other flow path.

20 Claims, 9 Drawing Sheets

(56) References Cited

U.S. PATENT DOCUMENTS

| | | | | |
|---|---|---|---|---|
| 2010/0186949 | A1* | 7/2010 | Xu | E21B 33/13<br>166/250.01 |
| 2012/0273213 | A1 | 11/2012 | Blalock et al. | |
| 2014/0155965 | A1* | 6/2014 | Kulstad | A61F 7/12<br>607/105 |
| 2017/0074072 | A1 | 3/2017 | Peters et al. | |

* cited by examiner

CONCENTRIC COILED TUBING DOWNLINE FOR HYDRATE REMEDIATION

BACKGROUND

The present disclosure relates generally to hydrate remediation in oil and gas environments and, more particularly, to a concentric coiled tubing downline used for hydrate remediation.

Gas hydrates are solids that may form when water molecules become bonded together after coming into contact with certain "guest" gas or liquid molecules under certain temperature and pressure conditions (e.g., high pressure and low temperature). Gas hydrates may agglomerate in a fluid that is flowing or that is substantially stationary. For example, gas hydrates may form during hydrocarbon production from a subterranean formation, in particular in pipelines and other equipment during production operations. Shut-in gas wells are particularly prone to hydrate problems if the well has been producing some water, leading to large plugs of hydrate tens or hundreds of meters long. Hydrate formation also may take place in shut-in oil wells, generating a slurry of solid that is capable of accumulating and plugging the pipeline. Hydrates may, in some cases, impede or completely block flow of hydrocarbons or other fluid flowing through pipelines. These blockages may decrease or stop production, potentially costing millions of dollars in lost production.

Several techniques exist for remediation of hydrates upon their formation in production equipment. For example, many of the same chemicals and technologies used to inhibit hydrate formation are also useful for removing solid hydrates that have already formed. One method to remove solid hydrates is to reduce the pressure above the hydrate plug sufficiently enough to reverse the equilibrium reaction that caused the hydrate to form. Existing techniques for reducing the pressure to remove hydrates include the use of subsea pumps in any of a variety of flow configurations intended to reduce pressure at the location of hydrate formation. Such equipment may be deployed via remote operated vehicles (ROV). These systems may be inefficient and the pumps may even stop working as fluid pressure is reduced and the hydrates dissolve, forming gas. Other methods for removing solid hydrates include chemical dissolution through the addition of solvents such as alcohols or glycols, and/or increasing the temperature through chemical heating and similar means.

BRIEF DESCRIPTION OF THE DRAWINGS

These drawings illustrate certain aspects of some of the embodiments of the present disclosure, and should not be used to limit or define the claims.

Figure 1:
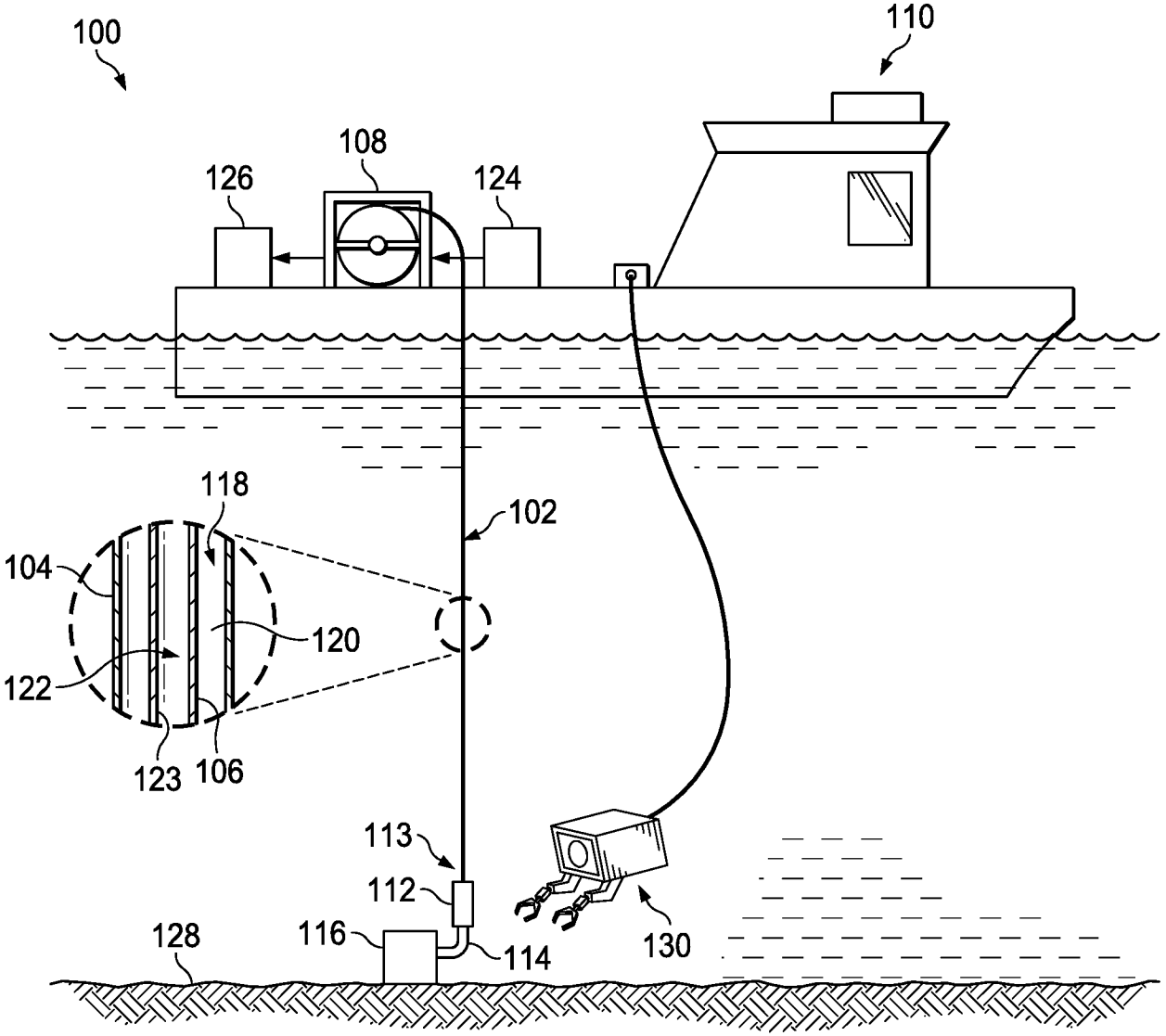
FIG. 1 is a partial cross-sectional view of a hydrate remediation system including a concentric coiled tubing downline, in accordance with an embodiment of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF CERTAIN EMBODIMENTS

To facilitate the present disclosure, various examples are disclosed that, in any given example, do not necessarily limit the scope of how the disclosure may be implemented. Embodiments of the present disclosure may be applicable to horizontal, vertical, deviated, or otherwise nonlinear wellbores in any type of subterranean formation. Embodiments may be applicable to injection or monitoring wells as well as production wells, including hydrocarbon wells. Embodiments of the present disclosure may also be applicable to pipelines as well as any subsea infrastructure in which hydrates may form. Embodiments may be implemented using a concentric coiled tubing downline that is made suitable for removing solid hydrates from infrastructure associated with a well or pipeline.

The present disclosure is directed to a system and method for hydrate remediation using a concentric coiled tubing downline. The concentric coiled tubing downline is used to remove solid hydrates from a component of infrastructure associated with a subsea well, pipeline, or subsea infrastructure. The concentric coiled tubing downline may be connected via a flexible jumper to the subsea infrastructure component and used to direct pressurized gas downhole down one flow path and allow effluent from the hydrate removal process to flow up to the surface via another flow path. The concentric coiled tubing downline may be connected to the subsea infrastructure component either directly or via a flexible jumper.

The disclosed systems and methods utilize a single concentric coiled tubing downline to provide hydrate removal at a subsea interface. The concentric coiled tubing downline includes an outer coiled tubing and an inner coiled tubing, the inner coiled tubing being disposed within the outer coiled tubing and extending at least partially through the outer coiled tubing. The concentric coiled tubing downline may be deployed through the water column from a single surface reel housed on a surface vessel. The disclosed systems may include a bottom hole assembly (BHA) located at a distal end of the concentric coiled tubing, and the BHA includes at least a subsea connector, which may be at a distal end of a flexible jumper of the BHA. The subsea connector of the BHA is configured to be directly connected to the subsea interface that will be depressurized via the concentric coiled tubing downline. The concentric coiled tubing downline provides two flow paths, one in the inner coiled tubing and the other in an annulus between the inner coiled tubing and the outer coiled tubing. The disclosed methods involve flowing pressurized gas down one of the two flow paths, and allowing effluent from the hydrate remediation process to flow up to the surface via the other of the two flow paths.

The disclosed systems and methods provide efficient hydrate remediation using a compact assembly, since only one coiled tubing reel and ROV is needed for the installation. Using a single coiled tubing downline enables fast installation of the hydrate remediation system, since only one subsea connection is made during the installation process. In addition, the two flow paths through the disclosed concentric coiled tubing downline may be remotely isolated without ROV input. Once an ROV stabs the connector at the end of a flexible jumper of the BHA of the concentric coiled tubing downline into the subsea infrastructure, this completes all ROV work in the deployment and operation of the hydrate remediation system. Thus, the concentric coiled tubing downline can be deployed and operated using one ROV.

In some embodiments, the BHA of the concentric coiled tubing downline may be equipped with one or more remotely operable valves as well as sensors to monitor temperature and pressure on the concentric coiled tubing, pressurized gas input, and effluent output. The remote operation of these valves and sensors enables real-time monitoring of the concentric coiled tubing downline and the connected subsea infrastructure, instead of relying on intermittent monitoring of pressure gauges via an ROV.

In addition, the disclosed concentric coiled tubing downline interfaces through a flexible jumper directly into the subsea infrastructure needing hydrate removal, enabling time-efficient and space-efficient installation of the hydrate remediation system.

Turning now to the drawings, FIG. 1 illustrates a system 100 that may be used for hydrate remediation, the system 100 including a concentric coiled tubing downline 102 in accordance with an embodiment of the present disclosure. The concentric coiled downline 102 includes an outer coiled tubing 104 and an inner coiled tubing 106. The inner coiled tubing 106 is concentric with the outer coiled tubing 104 and extends at least partially through the outer coiled tubing 104. As such, the concentric coiled tubing downline 102 features the inner coiled tubing string 106 situated within the outer coiled tubing string 104. The concentric coiled tubing downline 102 may be deployed through the water column from a single surface reel 108 housed on a surface vessel 110. A bottom hole assembly (BHA) 112 is attached to a distal (lower) end 113 of the concentric coiled tubing downline 102 extending away from the vessel 110. The BHA 112 may include, among other things, a subsea connector 114 at an end of a flexible jumper configured to connect the BHA 112 directly to a subsea infrastructure 116.

The concentric coiled tubing downline 102 provides two flow paths within a single downline. Specifically, the concentric coiled tubing downline 102 provides a first (annular) flow path 118 formed in an annulus 120 between the outer coiled tubing 104 and the inner coiled tubing 106. The concentric coiled tubing downline 102 also provides a second (inner) flow path 122 formed in the inner coiled tubing 106. For example, the second (inner) flow path 122 may be formed in a bore 123 of the inner coiled tubing 106. The first and second flow paths 118 and 122, respectively, may each extend from a surface location to the BHA 112. Specifically, the flow paths 118 and 122 may extend from an end of the concentric coiled tubing downline 102 at the reel 108 to the distal end 113 of the concentric coiled tubing downline 102 connected to the BHA 112. In general, both the first and second flow paths 118 and 122 may be in fluid communication with a bore of the BHA 112. At a surface location, the first and second flow paths 118 and 122 may be separated from each other proximate the reel 108 and each flow path connected to one of a surface level pressurized gas source 124 and a surface level output tank 126.

The first flow path 118 and the second flow path 122 may provide fluid flow in opposite directions along the concentric coiled tubing downline 102. That is, the first (annular) flow path 118 may be connected to the pressurized gas source 124 and provide pressurized gas flow in a downward direction from the surface to the BHA 112, while the second (inner) flow path 122 is connected to the output tank 126 and provides depressurization/effluent flow from the BHA 112 to the surface. In another embodiment, the direction may be reversed. Specifically, the second (inner) flow path 122 may be connected to the pressurized gas source 124 and provide pressurized gas flow in a downward direction from the surface to the BHA 112, while the first (annular) flow path 118 is connected to the output tank 126 and provides depressurization/effluent flow from the BHA 112 to the surface.

The illustrated system 100 provides two conduits (flow paths 118 and 122) incorporated into the single concentric downline 102, thereby enabling a simple deployment process requiring a single connection of the downline 102 to subsea infrastructure 116.

The outer coiled tubing 104 and the inner coiled tubing 106 may be constructed of any desirable material having the appropriate strength and flexibility for coiled tubing applications. For example, in some embodiments the outer coiled tubing 104 and the inner coiled tubing 106 may be constructed from steel or other metals. In addition to or in lieu of metals, the outer coiled tubing 104 and the inner coiled tubing 106 may be constructed from any number of composite materials, such as plastics, fiberglass, polyurethane, or a combination thereof.

The subsea infrastructure 116 may include any subsea interface located at or proximate the seafloor 128. The subsea infrastructure 116 may be susceptible to hydrate formation, or may have one or more large plugs of solid hydrate formed therein. The subsea infrastructure 116 may include a pipeline end termination (PLET), a pipeline end manifold (PLEM), a subsea tree, or any other subsea component through which hydrocarbons may flow. The infrastructure 116 may be equipped with a hot stab to which the BHA 112 may connect for fluidly coupling the concentric coiled tubing downline 102 to the subsea infrastructure 116. The term "fluidly coupling" or "fluidly coupled" as used herein is intended to mean that there is either a direct or an indirect fluid flow path between two components.

The surface level pressurized gas source 124 is located on the surface vessel 110 and provides a source of pressurized gas or fluid flow. The pressurized gas or fluid provided from the gas source 124 may include nitrogen or some other pressurization medium. It may be desirable for the pressurized gas or fluid to be an inert gas. However, other pressurization media may be used in other embodiments. In embodiments where the pressurization medium is nitrogen, the pressurized gas source 124 may include a nitrogen membrane, or a cryogenic tank (e.g., liquid nitrogen tank). As discussed above, the pressurized gas source 124 may be communicatively coupled to one of the flow paths (118 or 122) of the concentric coiled tubing downline 102 to provide pressurization to the subsea infrastructure 116. The term "communicatively coupled" as used herein is intended to mean either a direct or an indirect communication connection. Such connection may be a wired or wireless connection. Thus, if a first device communicatively couples to a second device, that connection may be through a direct connection, or through an indirect communication connection via other devices and connections. In some embodiments, the pressurized gas source 124 may be physically coupled to the concentric coiled tubing downline 102 through a connection at one side of the surface reel 108. The terms "coupled," "couple," or "couples" as used herein are intended to mean either an indirect or a direct connection. Thus, if a first device couples to a second device, that connection may be through a direct connection, or through an indirect mechanical, electromagnetic, or electrical connection via other devices and connections. The term "physically coupled" refers to an indirect or direct mechanical connection.

The surface level output tank 126 is located on the vessel 110 as well and provides a means for depressurization of the subsea infrastructure 116, as well as a catchment area for effluent flowing away from the subsea infrastructure 116 upon depressurization of the subsea infrastructure 116. Opening the subsea infrastructure 116 to the output tank 126 via the concentric coiled tubing downline 102 reduces the hydrostatic head on the subsea infrastructure 116, and this pressure reduction causes hydrate disassociation in the subsea infrastructure 116. Effluent from this hydrate disassociation may flow to the surface level output tank 126 to provide hydrate remediation of the subsea infrastructure 116. In some embodiments, the output tank 126 may be physically coupled to the concentric coiled tubing downline 102 through a connection at an opposite side of the surface reel 108 from the pressurized gas source 124. In other embodiments, the surface reel 108 may include a shafted assembly that facilitates a connection of the output tank 126 to the concentric coiled tubing downline 102 on the same side of the surface reel 108 as the pressurized gas source 124.

As discussed above, the output tank 126 may be communicatively coupled to an opposite one of the flow paths (118 or 122) than the pressurized gas source 124 to provide depressurization of the subsea infrastructure 116. As such, a single concentric coiled tubing downline 102 is able to provide hydrate removal through depressurization.

The disclosed concentric coiled tubing downline 102 may also enable the removal of hydrates through chemical or thermal dissolution. For example, one of the flow paths (118 or 122) may serve as an input line for a solvent or heated fluid, similar to providing a pressurized gas or fluid, while the other one of the flow paths (118 or 122) may serve as a conduit for effluent flow or returns to the surface. In such instances, the pressurized gas source 124 may be replaced by a chemical solvent source and/or heated fluid source at the surface.

In some embodiments, the outer string 104 of the concentric coiled tubing downline 102 may serve as a primary interface with deployment equipment and the BHA 112 for connecting the downline 102 to the subsea infrastructure 116. Deployment equipment for the disclosed concentric coiled tubing downline 102 may include a remote operated vehicle (ROV) 130 that stabs the subsea connector 114 of the BHA 112 into the subsea infrastructure 116. Deployment of the hydrate remediation system of FIG. 1 may involve the use of only a single ROV 130. The ROV 130 may be used for rigging and de-rigging the concentric coiled tubing downline 102 to an interface point of the subsea infrastructure 116. The ROV 130 may make and break the primary subsea connection 114, but otherwise may not be used for any part of the remediation process. This reduces the time, cost, and number of ROVs associated with performing the hydrate remediation process using the disclosed system. Since only one ROV 130 may be used to perform the process, a smaller surface vessel 110 may be utilized to further decrease associated remediation costs.

Figure 2:
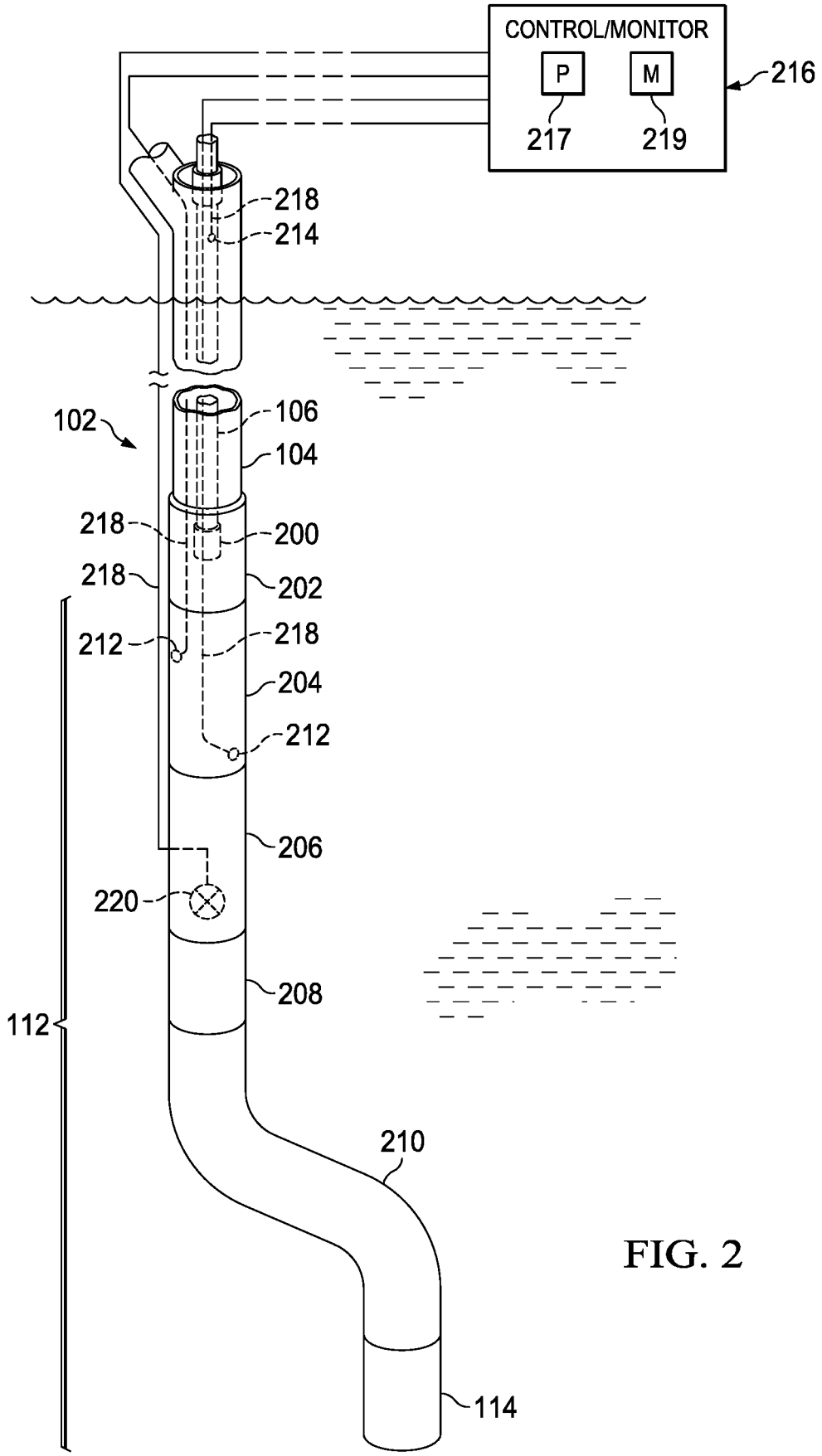
FIG. 2 is a schematic diagram illustrating a bottom hole assembly (BHA) of the hydrate remediation system of FIG. 1, in accordance with an embodiment of the present disclosure.

FIG. 2 provides a more detailed view of the concentric coiled tubing downline 102 and an embodiment of the BHA 112 attached to the distal end 113 of the downline 102. As illustrated, the BHA 112 coupled to the concentric coiled tubing downline 102 may include an assembly of components. A distal (subsea) end of the inner coiled tubing 106 may be terminated with a connector 200 and/or a flow control device (not shown). The distal (subsea) end of the outer coiled tubing 104 may be terminated with the features of the BHA 112.

The BHA 112 may include one or more of a connector 202, a clump weight, weighted sub, or weight carrier 204, a subsea disconnect or weak point 206, a swivel 208, a flexible jumper section 210, and the subsea connector 114. The connector 202 may connect the outer coiled tubing 104 to the other BHA components, while serving as a shroud for the end termination of the inner coiled tubing 106. The clump weight, weighted sub, or weight carrier 204 may help to draw the concentric coiled tubing downline 102 to the sea floor or desired intervention depth. The subsea disconnect or weak point 206 may enable rapid disconnection of the concentric coiled tubing downline 102 from the subsea infrastructure without the use of an ROV in the event of an emergency. The swivel 208 may allow the flexible jumper section 210 to rotate with respect to the rest of the BHA 112, allowing for relatively easy coupling of the BHA 112 to the subsea infrastructure via the connector 114 at the end of the jumper section 210. The subsea connector 114 is designed to interface directly with the target subsea infrastructure (e.g., 116 of FIG. 1). The subsea connector 114 may include a hot stab, although any number of alternate connector types may be used in other embodiments.

It should be noted that in some embodiments, the BHA 112 may not include all listed components described with reference to FIG. 2. In addition, the BHA 112 in other embodiments may feature additional components other than those shown such as, for example, a subsea wye, multiple jumper lines for connecting to multiple interface points, buoyancy devices, or other relevant components. The components of the BHA 112 located below the outer coiled tubing connector 202 may be standard components. The connector 202 coupled to the end of the outer coiled tubing 104 is a fluid routing conduit that provides enough room for the flow through the concentric coiled tubing downline 102 to make a U-turn between the annular flow path 118 and the inner flow path 122.

The BHA 112 provides a direct connection between the concentric coiled tubing downline 102 and the subsea infrastructure (e.g., 116 of FIG. 1) in which hydrate remediation is performed. This facilitates fast and easy installation of the hydrate remediation system, since the concentric coiled tubing downline 102 has only one end to be connected to the subsea infrastructure.

In some embodiments, the BHA 112 may be equipped with one or more sensors 212 used to provide real-time measurements of various parameters proximate the connection between the concentric coiled tubing downline 102 and the subsea infrastructure. The one or more sensors 212 may measure parameters including, but not limited to, pressure, temperature, pH, flow rate, and fluid composition. In addition to these subsea sensors 212, the overall system may be equipped with one or more sensors 214 at a surface level of the concentric coiled tubing downline 102 to provide data for comparison with the data collected by subsea sensors 212. In some embodiments, the one or more sensors 212 may provide real-time (or near real-time) measurements of the subsea parameters via remote communication from the sensors 212 to a control/monitoring system 216 at the surface.

The control/monitoring system 216 includes an information handling system having at least one processing component 217 and at least one memory component 219. For purposes of this disclosure, an information handling system may include any instrumentality or aggregate of instrumentalities that are configured to or are operable to compute, classify, process, transmit, receive, retrieve, originate, switch, store, display, manifest, detect, record, reproduce, handle, or utilize any form of information, intelligence, or data for any purpose, for example, for operation of equipment at a wellsite or a maritime vessel. In one or more embodiments, an information handling system may be a personal computer, a network storage device, or any other suitable device and may vary in size, shape, performance, functionality, and price. The memory component 219 may include random access memory (RAM), read-only memory (ROM), and/or other types of nonvolatile memory, while the processing component 217 may include one or more processing resources such as a central processing unit (CPU) or hardware or software control logic. Additional components of the information handling system may include one or more network ports for communication with external devices as well as various input and output (I/O) devices, such as a keyboard, a mouse, and a video display. The information handling system may also include one or more interface units capable of transmitting one or more signals to a controller, sensor, actuator, or like device.

In the control/monitoring system 216, the memory component 219 may store instructions that are executed on the processing component 217. For instance, the memory component 219 may store instructions that, upon execution by the processing component 217, cause the control/monitoring system 216 to receive various sensor signals from the sensors 212 and/or 214, process the sensor signals, and output one or more control signals based on the sensor signals. In some embodiments, the control/monitoring system 216 may output control signals to a subsea location to actuate one or more components located along the concentric coiled tubing downline 102, BHA 112, or subsea infrastructure. In some embodiments, the control/monitoring system 216 may output power to a subsea location to operate one or more of the sensors 212 or actuate a subsea component.

Telemetry equipment such as, for example, fiber or electrical cables 218 may be run down the concentric coiled tubing downline 102. One or more of the cables 218 may be run through the outer coiled tubing 104, through the inner coiled tubing 106, or along an external surface of the outer coiled tubing 104. The one or more cables 218 may communicate signals indicative of sensor data from the sensors 212 to the control/monitoring system 216. In some embodiments, one or more of the cables 218 may communicate power from the control/monitoring system 216 to power one or more of the sensors 212 in the BHA 112. In still other embodiments, one or more of the cables 218 may communicate power and/or control commands from the control/monitoring system 216 to one or more actuatable subsea components such as, for example, a remotely operated valve 220 in the BHA 112 or connected subsea infrastructure.

Turning back to FIG. 1, at a surface end of the concentric coiled tubing downline 102, both the annular flow path 118 and the inner flow path 122 may interface with a surface wye (not shown) contained within plumbing or a flow iron of the surface reel 108. FIGS. 3B, 3D, 4B, 4D, 7A, and 7B show such a surface wye 300. As illustrated in FIGS. 3B, 3D, 4B, 4D, 7A, and 7B, the inner flow path 122 of the concentric coiled tubing downline 102 may terminate in a main path 302 of the wye 300, isolating it from the flow and pressure of the annular flow path 118. The annular flow path 118 of the concentric coiled tubing downline 102 may terminate into a surface union connected to the wye 300, enabling a flow path through a side branch 304 of the wye 300 isolated from flow and pressure of the inner flow path 122.

Having described the concentric coiled tubing downline 102 and general arrangement of components of the BHA 112, a more detailed discussion of various methods for providing hydrate remediation via the concentric coiled tubing downline 102 will now be provided.

Figure 3A:
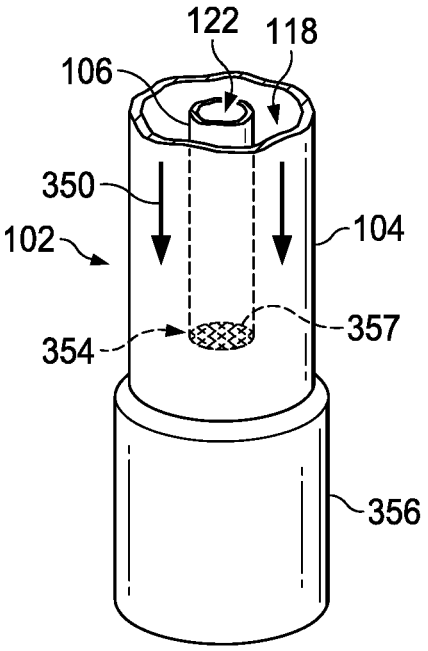
FIGS. 3A and 3B are partial cross-sectional views of opposing ends of a concentric coiled tubing downline while the concentric coiled tubing downline directs pressurized fluid toward a BHA, in accordance with an embodiment of the present disclosure.
Figure 3B:
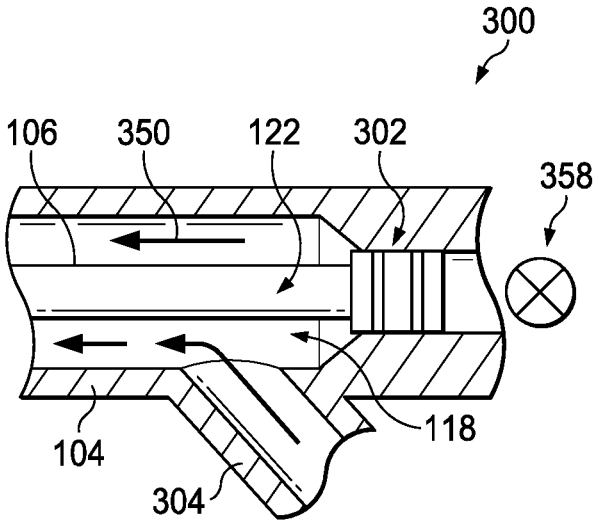
Figure 3C:
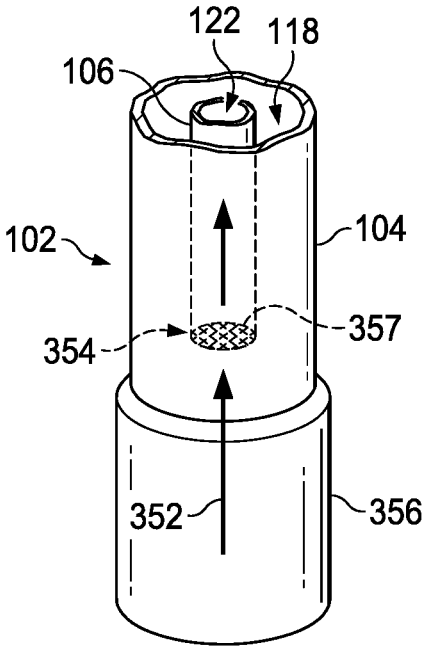
FIGS. 3C and 3D are partial cross-sectional views of opposing ends of the concentric coiled tubing downline of FIGS. 3A and 3B while the concentric coiled tubing downline allows effluent to flow toward the surface, in accordance with an embodiment of the present disclosure.
Figure 3D:
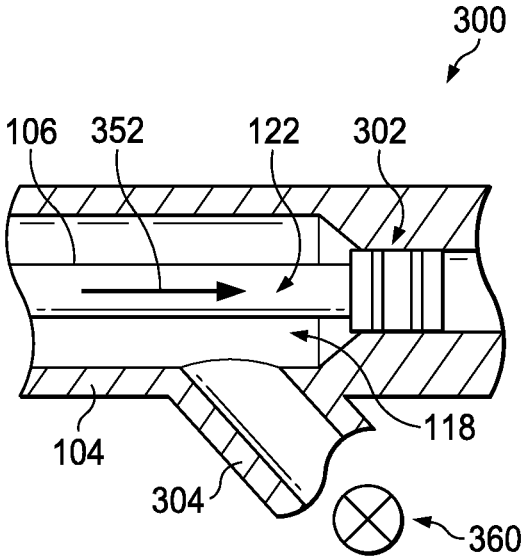

FIGS. 3A-3D illustrate an operation of an embodiment of the concentric coiled tubing downline 102. The system may be configured to provide an injection flow (arrows 350) of pressurized gas or fluid pumped down the annular flow path 118 as shown in FIGS. 3A and 3B, and effluent flow (arrows 352) returning up the inner flow path 122 as shown in FIGS. 3C and 3D. The annular flow path 118 provides the pressurized gas/fluid flow from the surface to the BHA for pressurizing the connected subsea infrastructure, while the inner flow path 122 provides the depressurization/effluent flow from the subsea infrastructure up to the surface.

By using this configuration with downward flow through the annular flow path 118 and upward effluent flow through the inner flow path 122, the coiled tubing assembly may provide a reliably sized flow path for the effluent being removed from the subsea infrastructure. Specifically, the inner flow path 122 provides a uniform diameter flow path (compared to the annular flow path 118 with a variable cross-section along the length of the coiled tubing) through which larger chunks of hydrate can be removed to the surface. In addition, if the inner flow path 122 becomes blocked by solid hydrate, the inner coiled tubing 106 may subsequently be removed to the surface and cleaned out (or replaced) without having to remove the outer coiled tubing 104.

In the illustrated embodiment, a distal end 354 of the inner coiled tubing 106 and a distal end 356 of the outer coiled tubing 104 may be open, e.g., without in-line check valves. In some embodiments, the inner coiled tubing 106 may be outfitted with a screen or mesh 357 at the distal end to prevent large pieces of solid hydrate from entering the inner flow path 122. The depressurization of a hydrate blockage in the subsea infrastructure may be achieved by shutting in one or more of the flow paths 118 and 122 of the concentric coiled tubing downline 102. For example, the inner flow path 122 may be shut-in via a surface valve (358) along the main path 302 of the wye 300 to prevent or minimize fluid flow through the inner flow path 122. Similarly, the annular flow path 118 may be shut-in via a surface valve (360) along the branch 304 of the wye 300 to prevent or minimize fluid flow through the annular flow path 118.

FIG. 3B illustrates the surface wye 300 of the concentric coiled tubing downline 102 during a pressurization operation. During pressurization, the inner flow path 122 may be shut-in via closure of the surface valve 358 so that the gas or fluid pumped down the annular flow path 118 does not flow back up the inner flow path 122. FIG. 3D illustrates the surface wye 300 during a depressurization operation. During depressurization, the annular flow path 118 may be shut-in via closure of the surface valve 360 so that the effluent being drawn to the surface does not flow up the annular flow path 118.

In other embodiments, surface valves 358 and 360 may either not be present at all or not used during normal operations. The depressurization of a hydrate blockage in the subsea infrastructure may be accomplished using continuous circulation through the concentric coiled tubing downline 102. That is, both flow paths 118 and 122 may remain open so that pressurization and depressurization happens substantially simultaneously. The pressurized gas or fluid pumped down through the annular flow path 118, along with the open inner flow path 122 up to the surface, cause a Venturi effect at the bottom of the concentric coiled tubing downline 102 to draw effluent up to the surface through the inner flow path 122.

Figure 4A:
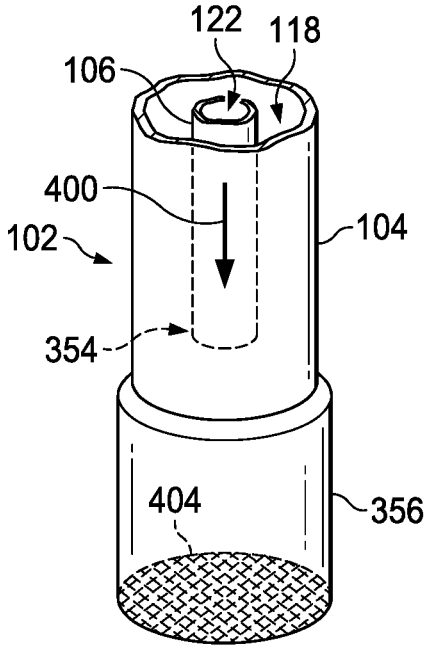
FIGS. 4A and 4B are partial cross-sectional views of opposing ends of a concentric coiled tubing downline while the concentric coiled tubing downline directs pressurized fluid toward a BHA, in accordance with an embodiment of the present disclosure.
Figure 4B:
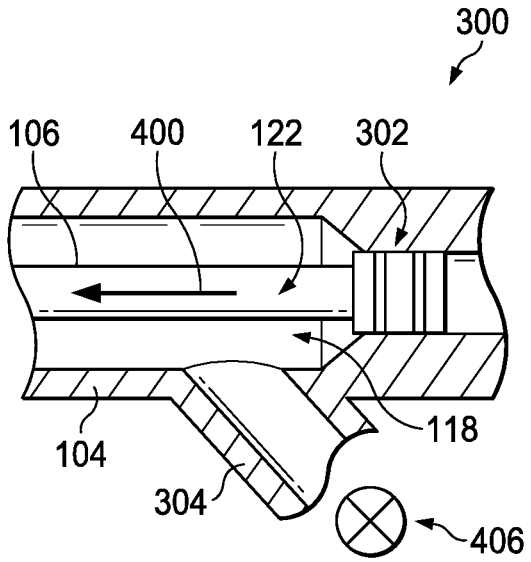
Figure 4C:
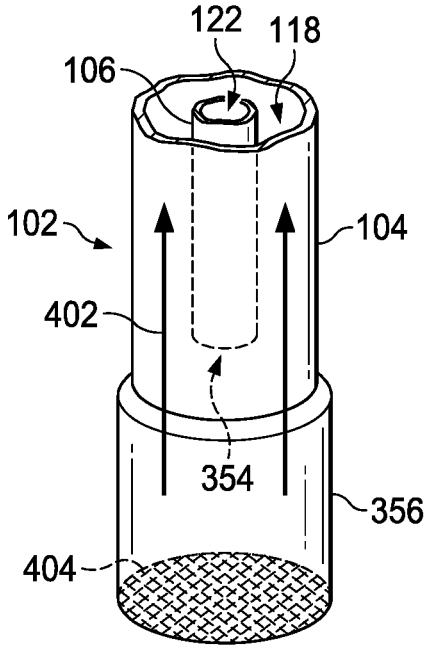
FIGS. 4C and 4D are partial cross-sectional views of opposing ends of the concentric coiled tubing downline of FIGS. 4A and 4B while the concentric coiled tubing downline allows effluent to flow toward the surface, in accordance with an embodiment of the present disclosure.
Figure 4D:
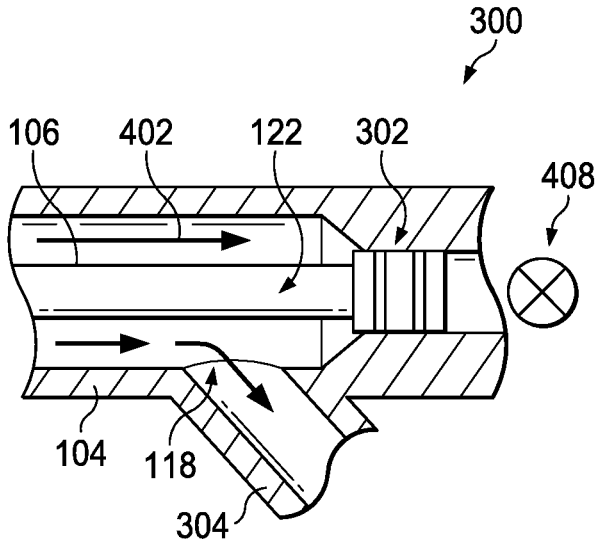

FIGS. 4A-4D illustrate an operation of another embodiment of the concentric coiled tubing downline 102 with an opposite circulation direction to the system of FIGS. 3A-3D. The system may be configured to provide an injection flow (arrows 400) of pressurized gas or fluid pumped down the inner flow path 122 as shown in FIGS. 4A and 4B, and effluent flow (arrows 402) returning up the annular flow path 118 as shown in FIGS. 4C and 4D. The inner flow path 122 provides the pressurized gas/fluid flow from the surface to the BHA for pressurizing the connected subsea infrastructure, while the annular flow path 118 provides the depressurization/effluent flow from the subsea infrastructure up to the surface.

In the illustrated embodiment, the distal end 354 of the inner coiled tubing 106 and the distal end 356 of the outer coiled tubing 104 may be open, e.g., without in-line check valves. In some embodiments, the outer coiled tubing 104 may be outfitted with a screen or mesh 404 at the distal end 356 to prevent large pieces of solid hydrate from entering the annular flow path 118. The depressurization of a hydrate blockage in the subsea infrastructure may be achieved by shutting in one or more of the flow paths 118 and 122 of the concentric coiled tubing downline 102. For example, the annular flow path 118 may be shut-in via a surface valve (406) along the branch 304 of the wye 300 to prevent or minimize fluid flow through the annular flow path 118. Similarly, the inner flow path 122 may be shut-in via a surface valve (408) along the main path 302 of the wye 300 to prevent or minimize fluid flow through the inner flow path 122.

FIG. 3B illustrates the surface wye 300 of the concentric coiled tubing downline 102 during a pressurization operation. During pressurization, the annular flow path 118 may be shut-in via closure of the surface valve 406 so that the gas or fluid pumped down the inner flow path 122 does not flow back up the annular flow path 118. FIG. 3D illustrates the surface wye 300 during a depressurization operation. During depressurization, the inner flow path 122 may be shut-in via closure of the surface valve 408 so that the effluent being drawn to the surface does not flow up the inner flow path 122.

In other embodiments, surface valves 406 and 408 may either not be present at all or not used during normal operations. The depressurization of a hydrate blockage in the subsea infrastructure may be accomplished using continuous circulation through the concentric coiled tubing downline 102. That is, both flow paths 118 and 122 may remain open so that pressurization and depressurization happens substantially simultaneously. The pressurized gas or fluid pumped down through the inner flow path 122, along with the open annular flow path 118 up to the surface, cause a Venturi effect at the bottom of the concentric coiled tubing downline 102 to draw effluent up to the surface through the annular flow path 118.

With surface shut-in used for either circulation direction (as described with reference to FIGS. 3A-4D), there is no need for additional flow control devices (e.g., in-line check valves) located along the coiled tubing strings. In other embodiments, however, it may be desirable to include check valves integrated into one or both of the coiled tubing strings to provide additional redundancy or a failsafe in the event of a malfunction with the surface shut-in valves. Examples of embodiments where flow control devices are used in the concentric coiled tubing downline 102 are provided in FIGS. 5A-10.

FIGS. 5A, 5B, 6A, and 6B illustrate embodiments of the concentric coiled tubing downline 102 having a flow control device 500 that terminates the inner coiled tubing 106. In the illustrated embodiments, the components attached to the distal end 354 of the inner coiled tubing 106 may include the coiled tubing connector 200 and a backpressure valve 504. The coiled tubing connector 200 may include an internal or external connector, a slip-type connector, a dimple-type connector, a roll-on connector, a weld-on connector, or any combination thereof. For example, the coiled tubing connector 200 may include an internal dimple-type connector that retains a uniform outer diameter with the inner coiled tubing 106.

Figure 5A:
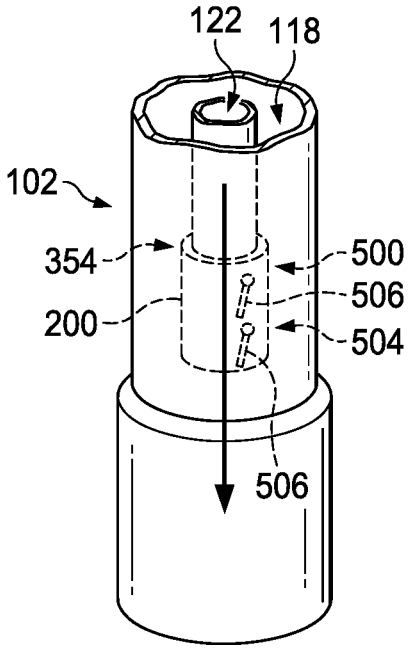
FIGS. 5A and 5B are partial cross-sectional views of a distal end of a concentric coiled tubing downline having a one-way valve in the inner coiled tubing, in accordance with an embodiment of the present disclosure.
Figure 5B:
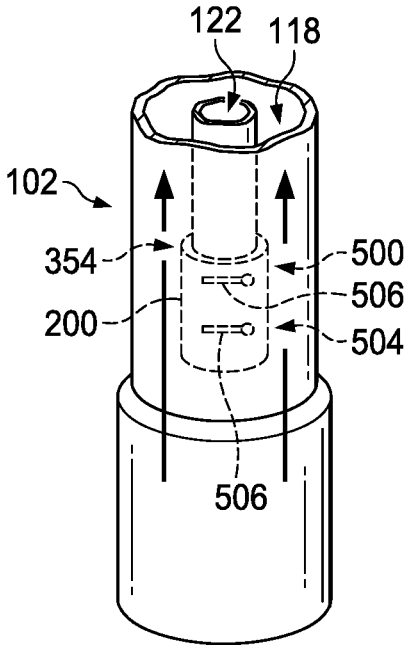

The backpressure valve 504 may be located below the coiled tubing connector 200. Any desired type of backpressure valve 504 may be used to terminate the inner coiled tubing 106. For example, FIGS. 5A and 5B illustrate the backpressure valve 504 as being a flapper-type backpressure valve having a series of flappers 506. The flappers 506 are biased toward a closed position (FIG. 5B) in which the flappers 506 are perpendicular to the inner flow path 122 to close off the flow path. The flappers 506 are forced into an open position (FIG. 5A) in response to pressure being applied to the flappers 506 in a downward direction. That way, flow of pressurized gas/fluid from the surface toward the subsea end of the coiled tubing downline 102 is allowed via the inner flow path 122. Flow of effluent from the subsea end up to the surface is not allowed through the inner flow path 122, since pressure applied in this direction closes the flappers 506. Although two flappers 506 are shown in the illustrated backpressure valve 504, other numbers of flappers 506 (e.g., 1, 3, 4, 5, or more) or other types of flow control mechanisms may be utilized.

Figure 6A:
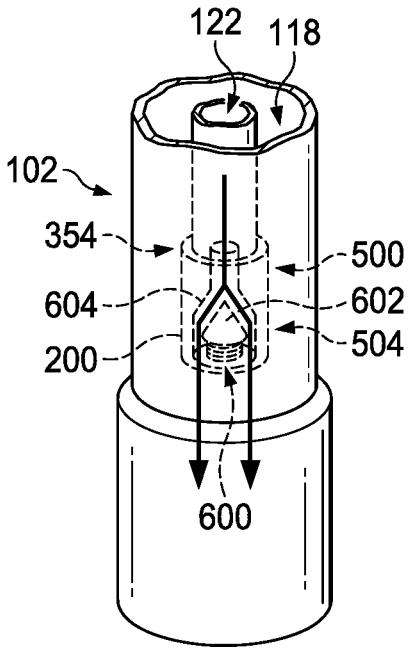
FIGS. 6A and 6B are partial cross-sectional views of a distal end of a concentric coiled tubing downline having a one-way valve in the inner coiled tubing, in accordance with an embodiment of the present disclosure.
Figure 6B:
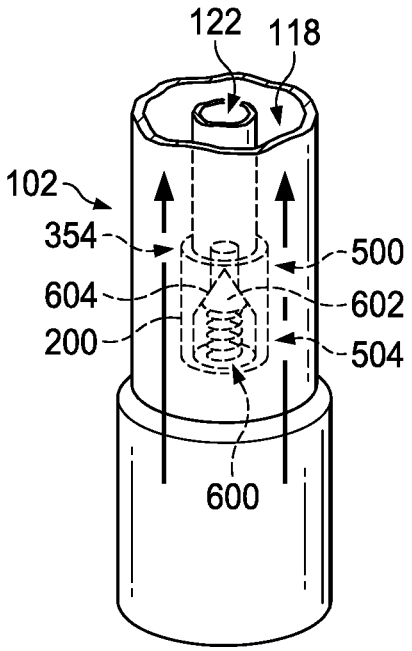

FIGS. 6A and 6B show another embodiment of the concentric coiled tubing assembly where the back-pressure valve 504 includes at least one dart-type check valve 600. The dart-type check valve 600 includes a spring-loaded dart 602 biased in a direction toward a complementary seat 604 formed in the bore. When the dart 602 engages with the seat 604, this seals the inner flow path 122. Applying pressure in a downward direction through the inner coiled tubing 106, as shown in FIG. 6A, compresses the spring and separates the dart 602 from the seat 604 to allow fluid flow around the dart 602 and through the inner flow path 122. When pressure is applied in an upward direction, as shown in FIG. 6B, the spring biases the dart 602 against the seat 604 to prevent flow of effluent into the inner coiled tubing 106.

Figure 7A:
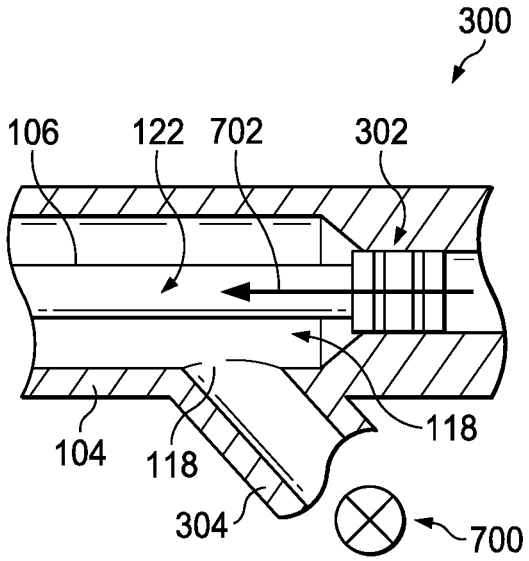
FIGS. 7A and 7B are partial cross-sectional views of a wye connection at a surface end of a concentric coiled tubing downline, in accordance with an embodiment of the present disclosure.
Figure 7B:
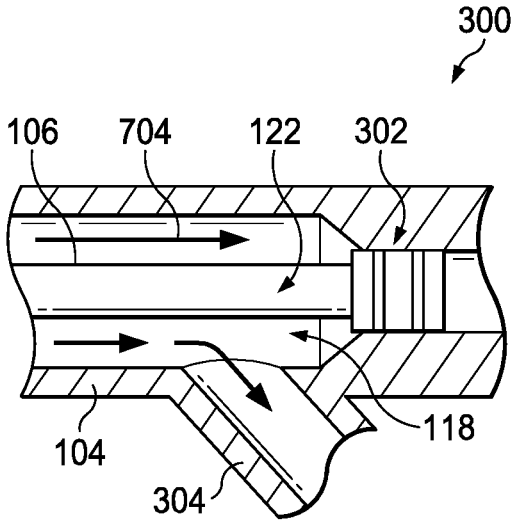

FIGS. 7A and 7B illustrate a surface wye 300 associated with an embodiment of the concentric coiled tubing downline 102 having a backpressure valve in the inner coiled tubing 106 (as described with reference to FIGS. 5A-6B). In either embodiment of FIGS. 5A-6B, the flow control device 500 enables the following process involving the surface wye 300 of FIGS. 7A and 7B. With the concentric coiled tubing downline 102 connected to the subsea interface point, flow through the inner flow path 122 is allowed to pass through the flow control device (e.g. 500 of FIGS. 5A-6B) into a common flow area through an inner diameter of the BHA connected to the outer coiled tubing 104.

Pressurization is enabled by shutting in the annular flow path 118 by closing a shut-in valve 700 at the surface of the outer coiled tubing 104, plumbed to the wye 300. In this manner, system pressure may be applied by actively pumping (arrows 702) the pressurized medium down the inner flow path 122 to pressurize the hydrate deposit. The flow control device connected to the inner coiled tubing 106 remains open during pressurization down the inner flow path 122, as described above.

To vent pressure and enable effluent flow to the surface (arrows 704), pumping/injection through the inner flow path 122 is halted and the shut-in valve 700 plumbed to the outer coiled tubing 104 is opened. It should be noted that in some embodiments, continuous circulation may be sufficient to effect depressurization in a concentric coiled tubing downline 102 having a backpressure valve 504 as shown in FIGS. 5A-6B. The flow control device connected to the inner coiled tubing 106 closes upon encountering pressure from below, as described above. This effectively seals the inner flow path 122 from the BHA, thereby allowing effluent flow to return to the surface via the annular flow path 118.

Figure 8:
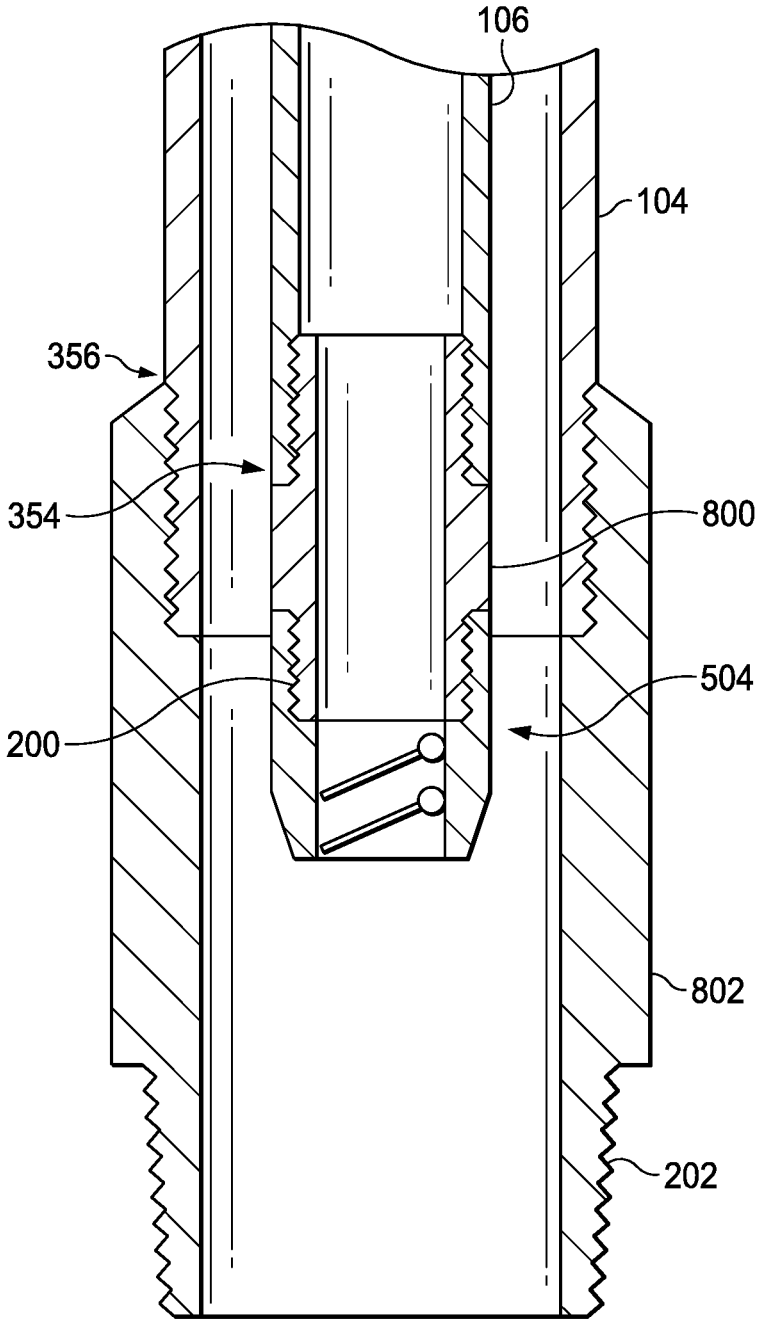
FIG. 8 is a cross-sectional view of a distal end of a concentric coiled tubing downline, in accordance with an embodiment of the present disclosure.

FIG. 8 illustrates a more detailed embodiment of the distal ends 354 and 356 of the inner coiled tubing 106 and outer coiled tubing 104, respectively. In the illustrated embodiment, the inner coiled tubing 106 may include a sub 800 having the internal coiled tubing connector 200 and a dual flapper isolation valve 504 (similar to what is described above with reference to FIGS. 5A and 5B). The outer coiled tubing 104 may include a sub 802 having an external coiled tubing connector 202, which shrouds the inner sub 800. The sub 802 may terminate with an attachment mechanism for connecting the outer coiled tubing 104 to the next desired sub in the BHA assembly.

In the embodiment illustrated in FIG. 8, the outer sub 802 uses a pin-type connector. It should be noted, however, that other types of connectors may be used for the external coiled tubing connector 202. For example, other embodiments of the outer sub 802 may utilize a box-type connector, a Grayloc® connector (available from Grayloc Products, LLC), a hubbed connector, a flanged connector, a combination anti-rotation self-aligning connector (C.A.R.S.A.C.), or any other non-interfacing configuration in which the inner and outer subs 800 and 802 are entirely separate components. This allows the outer sub 802 to simply include or connect to a standard downline BHA.

The illustrated embodiment of FIG. 8 shows the inner coiled tubing 106 terminating before the distal end of the outer coiled tubing 104. In other embodiments, however, the inner coiled tubing 106 may protrude further than the outer coiled tubing 104, thus enabling connection of the inner sub 800.

Figure 9:
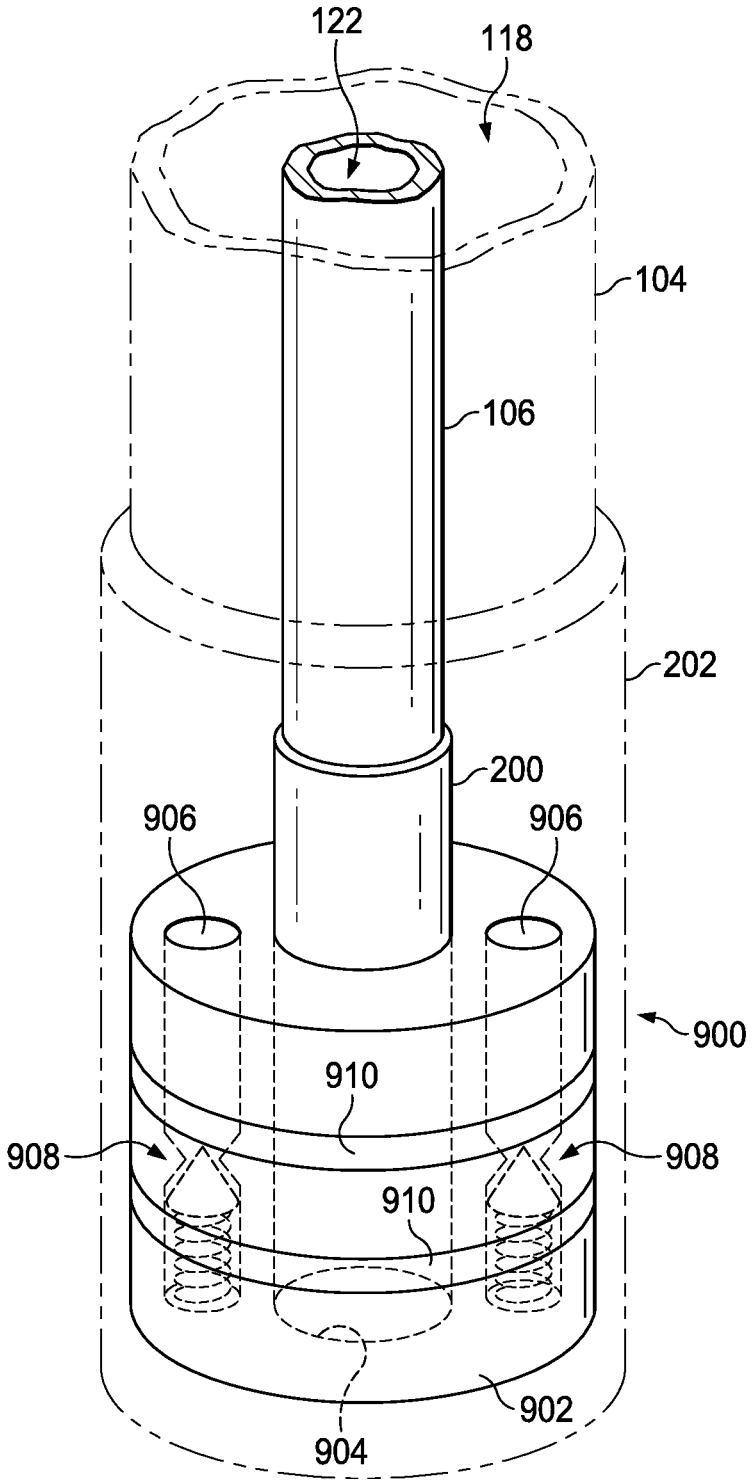
FIG. 9 is a perspective schematic view of a valve sub located at a distal end of a concentric coiled tubing downline, in accordance with an embodiment of the present disclosure.
Figure 10:
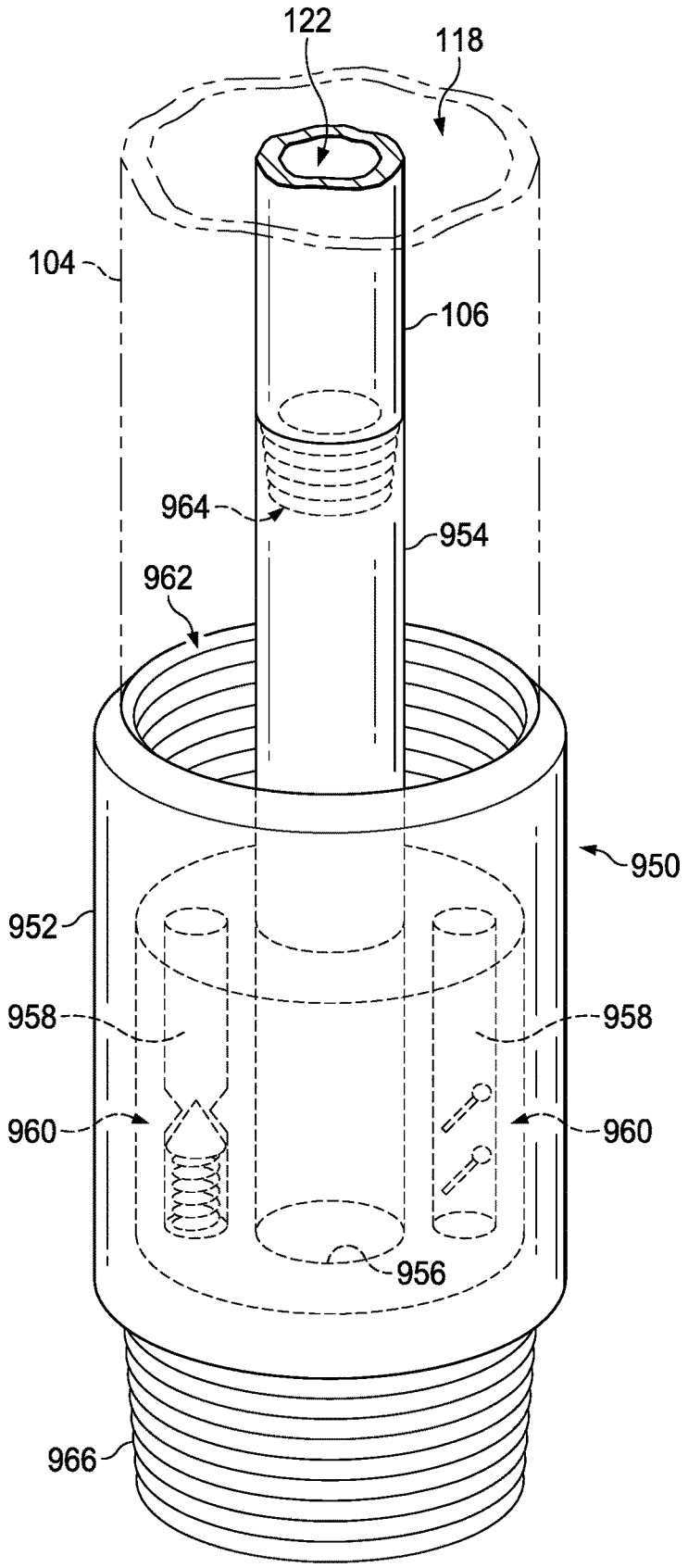
FIG. 10 is a perspective schematic view of a valve sub located at a distal end of a concentric coiled tubing downline, in accordance with an embodiment of the present disclosure.

In embodiments where pressurization is provided down the annular flow path 118 and effluent flow is routed up the inner flow path 122, it may be desirable to incorporate a backpressure valve at the distal end of the concentric coiled tubing downline 102. FIGS. 9 and 10 illustrate two embodiments of such an assembly. In FIG. 9, the concentric coiled tubing downline 102 may include an annular check sub 900 disposed within the annulus 120 between the outer coiled tubing 104 and the inner coiled tubing 106. The sub 900 may include a housing 902 with a main bore 904 formed therethrough to provide through-bore access to the inner coiled tubing 106. The sub 900 may also include one or more ports 906 formed through the housing 902 linking a location below the sub 900 to the annular flow path 118. The port(s) 906 may incorporate backpressure valves 908 therein to enable automatic shut-in of the annular flow path 118 if there is no active injection or circulation from the surface. These backpressure valves 908 may include, for example, flapper-type valves, dart-type valves, or any other desired one-way check valves.

In the illustrated embodiment, the sub 900 may be entirely separate from one of the coiled tubing strings. The sub 900 may include either a set of annular seals 910 or the provision of a metal to meal seal when connected to the outer coiled tubing 104. The annular check sub 900 of FIG. 9, for example, may be attached to (or integral with) the inner coiled tubing 106, and the annular check sub 900 may apply one or more seals 910 between an outer surface of the sub 900 and an inner surface of the outer coiled tubing 104. In other embodiments, the sub 900 may be attached to (or integral with) the outer coiled tubing 104, and the sub 900 may create a seal between an inner surface of the sub 900 and an outer surface of the inner coiled tubing 106.

Another embodiment of an annular check sub 950 is illustrated in FIG. 10, in which the sub 950 is a single component designed to be connected to both the inner coiled tubing 106 and the outer coiled tubing 104. The outer coiled tubing 104 is illustrated in broken lines in FIG. 10. The annular check sub 950 may include a main tubular housing 952 and an inner tubing 954 extending from the main tubular housing 952. The main tubular housing 952 and inner tubing 954 may both include a main bore 956 formed therethrough to provide through-bore access to the inner coiled tubing 106. The sub 950 may also include one or more ports 958 formed through the main tubular housing 952 linking a location below the sub 950 to the annular flow path 118. The port(s) 958 may incorporate backpressure valves 960 therein to enable automatic shut-in of the annular flow path 118 if there is no active injection or circulation from the surface. These backpressure valves 960 may include, for example, flapper-type valves, dart-type valves, or any other desired one-way check valves.

The sub 950 of FIG. 10 is a separate piece from both the outer and inner coiled tubing strings 104 and 106. The sub 950 is therefore able to provide a direct connection to both the inner coiled tubing 106 and outer coiled tubing 104 so that no additional seals are needed. The sub 950 may include a first set of internal threads 962 at an upper end of the main tubular housing 952 to mate with complementary external threads (not shown) on a lower end of the outer coiled tubing 104. In other embodiments, the orientation of the threads relative to each other may be reversed such that the outer coiled tubing 104 functions as a box for a pin of the sub 950. The threads 962 may connect the sub 950 directly to a lower end of the outer coiled tubing 104.

The sub 950 may also include a second set of internal threads 964 at an internal portion of the extended inner tubing 954 of the sub 950 to mate with complementary external threads on a lower end of the inner coiled tubing 106. In other embodiments, the orientation of the threads relative to each other may be reversed such that the inner coiled tubing 106 functions as a box for a pin of the sub 950. The threads 964 may connect the sub 950 directly to a lower end of the inner coiled tubing 106 at approximately the same time that the threads 962 connect the sub 950 to the outer coiled tubing 104.

The threads 962 and 964 of the sub 950 may generally match the complementary threads on the outer and inner coiled tubing strings 104 and 106, respectively. The connection of the outer and inner coiled tubing strings 104 and 106 to the sub 950 may be made up simultaneously. In some embodiments, one or both of the coiled tubing strings 104 and 106 may be equipped with an extension neck that allows for an adjustment of an axial distance between distal ends of the outer coiled tubing 104 and the inner coiled tubing 106. This may allow for the use of the same sub 950 for a variety of overall geometries of the concentric coiled tubing downline 102. As illustrated, the sub 950 may also include external threads 966 on a lower end thereof that match the complementary threads on the connector (e.g., 200 of FIG. 2) of the outer coiled tubing string 104 so that the sub 950 may be directly connected to the lower tool assembly of the BHA.

An embodiment of the present disclosure is a system for removing hydrates from a subsea component including: a concentric coiled tubing downline having an outer coiled tubing and an inner coiled tubing; and a bottom hole assembly (BHA) disposed at a distal end of the concentric coiled tubing downline. The inner coiled tubing is concentric with the outer coiled tubing and extending at least partially through the outer coiled tubing, and the BHA includes a subsea connector.

In one or more embodiments described in the preceding paragraph, the concentric coiled tubing downline includes: a first flow path within an annulus between the outer coiled tubing and the inner coiled tubing; and a second flow path within the inner coiled tubing; wherein both the first and second flow paths are in fluid communication with a bore of the BHA. In one or more embodiments described in the preceding paragraph, the first flow path and the second flow path provide fluid flow in opposite directions along the concentric coiled tubing downline. In one or more embodiments described in the preceding paragraph, a distal end of the outer coiled tubing terminating proximate the BHA is entirely open to a distal end of the inner coiled tubing terminating proximate the BHA. In one or more embodiments described in the preceding paragraph, the system includes a first shut-in valve located at a surface position of the first flow path; and a second shut-in valve located at a surface position of the second flow path. In one or more embodiments described in the preceding paragraph, the system includes a wye fitting at a surface location of the concentric coiled tubing downline separating the first and second flow paths. In one or more embodiments described in the preceding paragraph, the system includes at least one backpressure valve disposed proximate a distal end of the inner coiled tubing permitting fluid flow in one direction through the second flow path. In one or more embodiments described in the preceding paragraph, the system includes at least one backpressure valve coupled to a distal end of the outer coiled tubing permitting fluid flow in one direction through the first flow path. In one or more embodiments described in the preceding paragraph, the system includes a screen or mesh covering an opening at a distal end of the inner coiled tubing. In one or more embodiments described in the preceding paragraph, the system includes: a surface level pressurization source fluidly coupled to one of the inner coiled tubing or outer coiled tubing; and a surface level return tank fluidly coupled to the other of the inner coiled tubing or outer coiled tubing. In one or more embodiments described in the preceding paragraph, the BHA further includes a flexible jumper, wherein the subsea connector is disposed on a distal end of the flexible jumper. In one or more embodiments described in the preceding paragraph, the system includes the subsea component, wherein the subsea connector is directly attached to the subsea component.

Another embodiment of the present disclosure is a method for removing hydrates from a subsea component including: connecting a concentric coiled tubing downline to the subsea component via a subsea connector in a bottom hole assembly (BHA) at a distal end of the concentric coiled tubing downline; directing a pressurized fluid flow from a surface to the subsea component via the concentric coiled tubing downline; and allowing effluent to flow from the subsea component to the surface via the concentric coiled tubing downline. The concentric coiled tubing downline has an outer coiled tubing and an inner coiled tubing concentric with and extending at least partially through the outer coiled tubing.

In one or more embodiments described in the preceding paragraph, the pressurized fluid flow is directed through a first flow path within an annulus between the outer coiled tubing and the inner coiled tubing, and the effluent is allowed to flow through a second flow path within the inner coiled tubing. In one or more embodiments described in the preceding paragraph, the method includes preventing the effluent from flowing through the first flow path via at least one backpressure valve disposed proximate a distal end of the outer coiled tubing. In one or more embodiments described in the preceding paragraph, the method includes straining a flow of the effluent entering the inner coiled tubing via a screen or mesh. In one or more embodiments described in the preceding paragraph, the effluent is allowed to flow through a first flow path within an annulus between the outer coiled tubing and the inner coiled tubing, and the pressurized fluid flow is directed through a second flow path within the inner coiled tubing. In one or more embodiments described in the preceding paragraph, the method includes preventing the effluent from flowing through the second flow path via at least one backpressure valve disposed proximate a distal end of the inner coiled tubing. In one or more embodiments described in the preceding paragraph, the method includes circulating the pressurized fluid flow through the concentric coiled tubing downline to draw the effluent out of the subsea component while maintaining a distal end of the outer coiled tubing open to a distal end of the inner coiled tubing terminating proximate the BHA. In one or more embodiments described in the preceding paragraph, the method includes: maintaining a distal end of the outer coiled tubing open to a distal end of the inner coiled tubing terminating proximate the BHA; and manipulating shut-in valves located at surface positions of a first flow path and a second flow path through the concentric coiled tubing downline to direct the pressurized fluid flow and allow the effluent to flow through the concentric coiled tubing downline.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (e.g., "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A system for removing hydrates from a subsea component, comprising:

a concentric coiled tubing downline having an outer coiled tubing and an inner coiled tubing concentric with the outer coiled tubing and extending at least partially through the outer coiled tubing;

a bottom hole assembly (BHA) coupled to a distal end of the concentric coiled tubing downline, the BHA including a subsea connector connecting the concentric coiled tubing downline to the subsea component;

a first flow path within an annulus between the outer coiled tubing and the inner coiled tubing;

a second flow path within the inner coiled tubing; and a flow space inside the concentric coiled tubing downline and located above the BHA, the flow space being fluidly connected to both the first flow path and the second flow path, wherein a distal end of the outer coiled tubing terminating proximate the BHA is entirely open to a distal end of the inner coiled tubing terminating proximate the BHA, and wherein the concentric coiled tubing downline has only one opening coupled to the BHA.

2. The system of claim 1, wherein the first flow path and the second flow path provide fluid flow in opposite directions along the concentric coiled tubing downline.

3. The system of claim 1, further comprising:

a first shut-in valve located at a surface position of the first flow path; and a second shut-in valve located at a surface position of the second flow path.

4. The system of claim 1, further comprising a wye fitting at a surface location of the concentric coiled tubing downline separating the first and second flow paths.

5. The system of claim 1, further comprising at least one backpressure valve disposed proximate a distal end of the inner coiled tubing permitting fluid flow in one direction through the second flow path.

6. The system of claim 1, further comprising at least one backpressure valve coupled to a distal end of the outer coiled tubing permitting fluid flow in one direction through the first flow path.

7. The system of claim 1, further comprising a screen or mesh covering an opening of the inner coiled tubing at a distal end of the inner coiled tubing.

8. The system of claim 1, further comprising:

a surface level pressurization source fluidly coupled to one of the inner coiled tubing or outer coiled tubing; and a surface level return tank fluidly coupled to the other of the inner coiled tubing or outer coiled tubing.

9. The system of claim 1, wherein the BHA further comprises a flexible jumper, wherein the subsea connector is disposed on a distal end of the flexible jumper, and wherein the subsea connector is directly attached to the subsea component.

10. The system of claim 1, wherein:

the distal end of the inner coiled tubing terminates within the outer coiled tubing; and the flow space is located between the distal end of the inner coiled tubing and the distal end of the outer coiled tubing.

11. The system of claim 1, wherein the concentric coiled tubing downline is capable of generating a pressure reduction at the distal end of the concentric coiled tubing downline.

12. The system of claim 1, wherein the BHA has a single proximal opening fluidly connected to the distal end of the concentric coiled tubing downline, and a single distal opening at an opposite end of the BHA with the subsea connector.

13. A method for removing hydrates from a subsea component, comprising:

connecting a concentric coiled tubing downline to the subsea component via a subsea connector in a bottom hole assembly (BHA) at a distal end of the concentric coiled tubing downline, the concentric coiled tubing downline having an outer coiled tubing and an inner coiled tubing concentric with and extending at least partially through the outer coiled tubing, the concentric coiled tubing downline having only one opening coupled to the BHA;

directing a pressurized fluid flow from a surface to the subsea component via the concentric coiled tubing downline, wherein the pressurized fluid flows through a flow space located inside the concentric coiled tubing downline and above the BHA;

allowing effluent to flow from the subsea component to the surface via the concentric coiled tubing downline, wherein the effluent passes through the flow space inside the concentric coiled tubing downline; and maintaining a distal end of the outer coiled tubing open to a distal end of the inner coiled tubing terminating proximate the BHA.

14. The method of claim 13, wherein the pressurized fluid flow is directed downward through a first flow path within an annulus between the outer coiled tubing and the inner coiled tubing to the flow space, and wherein the effluent is allowed to flow upward from the flow space through a second flow path within the inner coiled tubing.

15. The method of claim 14, further comprising preventing the effluent from flowing from the flow space through the first flow path via at least one backpressure valve disposed proximate a distal end of the outer coiled tubing.

16. The method of claim 13, wherein the effluent is allowed to flow upward from the flow space through a first flow path within an annulus between the outer coiled tubing and the inner coiled tubing, and wherein the pressurized fluid flow is directed downward through a second flow path within the inner coiled tubing to the flow space.

17. The method of claim 16, further comprising preventing the effluent from flowing through the second flow path via at least one backpressure valve disposed proximate a distal end of the inner coiled tubing.

18. The method of claim 13, further comprising circulating the pressurized fluid flow through the concentric coiled tubing downline to draw the effluent out of the subsea component while maintaining a distal end of the outer coiled tubing open to a distal end of the inner coiled tubing at the flow space.

19. The method of claim 13, further comprising:

manipulating shut-in valves located at surface positions of a first flow path and a second flow path through the concentric coiled tubing downline to direct the pressurized fluid flow and allow the effluent to flow through the concentric coiled tubing downline.

20. The method of claim 13, further comprising:

generating, by the concentric coiled tubing downline, a pressure reduction at the distal end of the concentric coiled tubing downline.

* * * * *